US009365042B2

(12) United States Patent
Ishizawa et al.

(10) Patent No.: US 9,365,042 B2
(45) **Date of Patent: *Jun. 14, 2016**

(54) LIQUID SUPPLY DEVICE AND LIQUID JETTING SYSTEM

(71) Applicant: Seiko Epson Corporation, Tokyo (JP)

(72) Inventors: Taku Ishizawa, Shiojiri (JP); Yoshiaki Shimizu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/320,474

(22) Filed: Jun. 30, 2014

(65) Prior Publication Data

US 2014/0313266 A1 Oct. 23, 2014

Related U.S. Application Data

(63) Continuation of application No. 13/225,248, filed on Sep. 2, 2011, now Pat. No. 8,807,717.

(30) Foreign Application Priority Data

Sep. 3, 2010 (JP) ..... 2010-197311
Jul. 25, 2011 (JP) ..... 2011-161966

(51) Int. Cl.
*B41J 2/175* (2006.01)
*B41J 2/17* (2006.01)

(52) U.S. Cl.
CPC ..... *B41J 2/175* (2013.01); *B41J 2/17523* (2013.01); *B41J 2/17553* (2013.01)

(58) Field of Classification Search
CPC .... B41J 2/175; B41J 2/17523; B41J 2/17553; B41J 2/17513; B41J 2/17596; B41J 2/1752; B41J 2/17556
USPC ..... 347/84, 85
See application file for complete search history.

(56) References Cited

U.S. PATENT DOCUMENTS 6,599,755 B1 7/2003 Eipel et al.
7,175,264 B2 2/2007 Qingguo et al.

(Continued)

FOREIGN PATENT DOCUMENTS

CN 101027186 B 12/2010
DE 2545372 A1 5/1977

(Continued)

OTHER PUBLICATIONS

Non-Final Office Action, dated Aug. 17, 2012, of related U.S. Appl. No. 13/225,248.

(Continued)

*Primary Examiner* — Jannelle M Lebron
(74) *Attorney, Agent, or Firm* — Kilpatrick Townsend & Stockton LLP

(57) ABSTRACT

A liquid supply device 10 is equipped with a liquid containing chamber 16, a transport tube 15 for sending the liquid inside the chamber 16 to a liquid jetting device 20, first and second members 171 and 172 sandwiching the tube 15, and a cam 173 that determines the position of the first member 171 relative to the second member 172. The tube 15 is equipped with an elastic portion 151 that elastically deforms and is flattened. In the first rotation position, the cam 173 arranges the first member 171 such that there is a space that allows the liquid to flow inside the part 151 between the first and second members 171, 172. In the second rotation position, the cam 173 arranges the first member 171 such that the elastic portion 151 is flattened by the first and second members 171, 172, and the liquid inside cannot flow.

6 Claims, 12 Drawing Sheets

(56) References Cited

U.S. PATENT DOCUMENTS

| | | | | |
|---|---|---|---|---|
| 7,281,785 | B2 | 10/2007 | Palifka et al. | |
| 8,807,717 | B2 * | 8/2014 | Ishizawa | B41J 2/175 347/84 |
| 2002/0085060 | A1 | 7/2002 | Usui et al. | |
| 2003/0048336 | A1 | 3/2003 | Kaga et al. | |
| 2007/0097188 | A1 | 5/2007 | Lewey et al. | |
| 2010/0128092 | A1 | 5/2010 | Nakamura | |

FOREIGN PATENT DOCUMENTS

| | | | |
|---|---|---|---|
| DE | 3429073 | A1 | 2/1985 |
| EP | 1519095 | A2 | 3/2005 |
| JP | 2004-330471 | A | 11/2004 |
| JP | 2005-178397 | A | 7/2005 |
| JP | 2005-219483 | A | 8/2005 |
| JP | 2006-069097 | A | 3/2006 |
| JP | 2008-513253 | A | 5/2008 |
| JP | 2009-126116 | A | 6/2009 |
| WO | 2006/034141 | A2 | 3/2006 |

OTHER PUBLICATIONS

Final Office Action, dated Oct. 1, 2013, of related U.S. Appl. No. 13/225,248.

Notice of Allowance, dated Mar. 31, 2014, of related U.S. Appl. No. 13/225,248.

* cited by examiner

LIQUID SUPPLY DEVICE AND LIQUID JETTING SYSTEM

CROSS-REFERENCE TO RELATED APPLICATIONS

The present application is a continuation of U.S. application Ser. No. 13/225,248 filed on Sep. 2, 2011, which claims the priority based on Japanese Patent Applications No. 2010-197311 filed on Sep. 3, 2010 and No. 2011-161966 filed on Jul. 25, 2011, the disclosures of which are hereby incorporated by reference in their entireties.

BACKGROUND

1. Technical Field

The present invention relates to a liquid supply device for supplying liquid to a liquid jetting device.

2. Related Art

Conventionally, a liquid supply device for supplying liquid to a liquid jetting device from outside is provided. The liquid jetting device receives supply of the liquid from the liquid supply device, and jets that liquid from a nozzle which is an aperture. When using such a liquid supply device and liquid jetting device, the vertical direction positional relationship of the liquid jetting device nozzle and the liquid supply device is kept almost constant. Because of this, the head differential of the nozzle and the liquid inside the liquid supply device is within a pre-assumed range. As a result, liquid does not leak from the nozzle which is an aperture that is one end of the liquid flow path.

However, with a liquid supply device and a liquid jetting device for which the liquid supply device can be moved relative to the liquid jetting device while the liquid supply device and the liquid jetting device remain connected, when the liquid jetting device and the liquid supply device are being moved, or when they are being repaired, there are times when the vertical direction positional relationship of the nozzle and the liquid supply device fall out of the assumed range. In such a case, when the liquid supply device is disposed at a position a certain degree higher than the nozzle, it is possible that liquid will leak out from the nozzle. With the prior art, such problems were not taken into consideration. This kind of problem exists widely with liquid supply devices and liquid jetting devices for which the liquid supply device can be moved relative to the liquid jetting device with the liquid supply device and the liquid jetting device remaining connected.

The present invention is created to address the problems described above at least in part, and with a liquid supply device that supplies liquid to a liquid jetting device, its object is to reduce the possibility of liquid leaking out with a liquid jetting device when the liquid supply device is moved relative to the liquid jetting device.

SUMMARY

The present invention is created to address the problems described above at least in part, and can be realized according to the following modes and application examples.

Aspect 1

A liquid supply device for supplying liquid to a liquid jetting device, the liquid supply device comprising:

a liquid containing chamber that contains liquid;

a tube for sending the liquid in the liquid containing chamber to the liquid jetting device, the tube including at least in part an elastic portion that can elastically deform and be flattened; and first and second members arranged sandwiching the elastic portion of the tube, wherein the first member is configured to be arranged at:

a first relative position relative to the second member, wherein there is a space between the second member and the first member at the first relative position, the space allowing the liquid to flow inside the elastic portion; and a second relative position relative to the second member that is closer to the second member than the first relative position, wherein the elastic portion is sandwiched and flattened by the second member and the first member at the second relative position, and the liquid cannot flow inside the elastic portion.

With such a liquid supply device, it is possible to supply liquid from the liquid supply device to the liquid jetting device by having a first member disposed in a first relative position. Meanwhile, disposing the first member at a second relative position makes liquid from the liquid supply device not flow from the liquid supply device to the liquid jetting device. Accordingly, by arranging the first member at the second relative position, even in cases when the liquid supply device is moved to a position higher than the liquid jetting device, it is possible to make liquid not leak from the part that jets liquid in the liquid jetting device.

Aspect 2

A liquid supply device according to aspect 1, further comprising:

an operating unit exposed to an outside of the liquid supply device, the operating unit selectively arranging the first member at least at the first relative position and the second relative position, wherein the operating unit is provided at a side matching a side of the liquid jetting device at which the liquid jetting device delivers an object on which the liquid is jetted, in an orientation of the liquid supply device when supplying liquid to the liquid jetting device.

With such a liquid supply device, the operating unit can be easily seen by the user who is using the liquid jetting device. Accordingly, the user can easily confirm whether the operating unit is set in the proper position. There is also a high probability of the user operating the operating unit in advance without forgetting. The exterior of the liquid supply device may be the outside of the outer shell of the liquid supply device, for example.

Aspect 3

A liquid supply device according to aspect 2 or 3, further comprising:

a cam that determines the relative position of the first member relative to the second member, wherein the cam at a first rotation position, arranges the first member at the first relative position, and at a second rotation position, arranges the first member at the second relative position.

With such a liquid supply device, it is possible to supply liquid from the liquid supply device to the liquid jetting device by having the cam be at a first rotation position. It is also possible to not have the liquid flow from the liquid supply device to the liquid jetting device by having the cam be at a second rotation position. Accordingly, by having the cam be at a second rotation position, it is possible to make liquid not leak from the part that jets liquid in the liquid jetting device, even when the liquid supply device is moved to a higher position than the liquid jetting device.

Aspect 4

A liquid supply device according to aspect 3 according to aspect 2, wherein the operating unit is connected to the cam such that a rotational motion performed on the operating unit can be transmitted to the cam.

With such a mode, it is possible to easily rotate the cam using the operating unit.

The operating unit preferably has a part projecting in the direction perpendicular to the axis of rotation of the operating unit. With such a mode, by operating the operating unit which is projected from the rotation axis, it is possible to switch the first rotation position and the second rotation position of the cam with less force than with a mode that does not have an operating unit.

Aspect 5

A liquid supply device according to aspect 4 wherein at the side at which the operating unit is provided, an outer shell of the liquid supply device comprises:

a first part that is plane shaped; and a second part provided at a position closer to the cam than the first part in a direction perpendicular to the first part, wherein the operating unit is connected to the cam via a hole provided in the second part, and is at a position closer to the cam than the first part in the direction perpendicular to the first part.

With such a mode, the operating unit is provided at a part set deeper overall than the first part. Accordingly, it is possible to have the operating unit not project further outside than the outer shell of the liquid supply device, or to have the projection amount be small. When the liquid supply device bumps into another structural object, the possibility of the first part colliding with the other structural object is high, and the possibility of the operating unit colliding with the other structural object is low. Specifically, there is little possibility of the cam receiving an impact from outside via the operating unit. Thus, there is little possibility of the operating unit and the cam being broken by an impact from the outside.

Note that the "outer shell of the liquid supply device" is acceptable as long as at least the side at which the operating unit of the liquid supply device is provided is covered, and it is not necessary to cover all of the top, bottom, front, back, and sides of the liquid supply device.

Aspect 6

A liquid supply device according to aspect 4 or 5 wherein the operating unit and the cam are provided as separate members.

With such a mode, when manufacturing the liquid supply device, it is possible to arrange the operating unit and the cam at the reverse sides sandwiching the outer shell of the liquid supply device, and to connect these. Accordingly, it is possible to easily manufacture a liquid supply device equipped with the cam arranged on the inside of the liquid supply device and the operating unit arranged on the outside.

Aspect 7

A liquid supply device according to aspect 4 comprising:

a plurality of sets of the liquid containing chamber and the tube, wherein a pair of the first and second members is arranged sandwiching elastic portions of the plurality of tubes, wherein the first member is arranged at the first relative position when the cam is at the first rotation position, wherein the first member at the first relative position allows the liquid to flow inside the elastic portions of the plurality of tubes, and is arranged at the second relative position when the cam is at the second rotation position, wherein the first member at the second relative position sandwiches with the second member the elastic portions to be flattened, whereby the liquid cannot flow inside the elastic portions.

With such a mode, it is possible to prohibit or allow the flow of liquid at a plurality of tubes by moving one cam. Specifically, it is possible to reduce the number of parts and to lower costs compared to when providing the first member and the second member individually on the plurality of tubes.

Aspect 8

A liquid jetting system comprising:

a liquid supply device according to aspect 1, and a liquid jetting device connected to the liquid supply device, the liquid jetting device having a head for jetting the liquid supplied from the liquid supply device on an object.

Note that the present invention can be realized with various modes such as the following: (1) Fluid container, liquid supply device, liquid supply method, (2) Flow control device, flow control method, (3) Ink container, ink supply device, (4) Liquid consuming device, ink jet printer.

These and other objects, features, aspects, and advantages of the present invention will become more apparent from the following detailed description of the preferred embodiments with the accompanying drawings.

DESCRIPTION OF THE PREFERRED EMBODIMENT

A. First Embodiment

Figure 1:
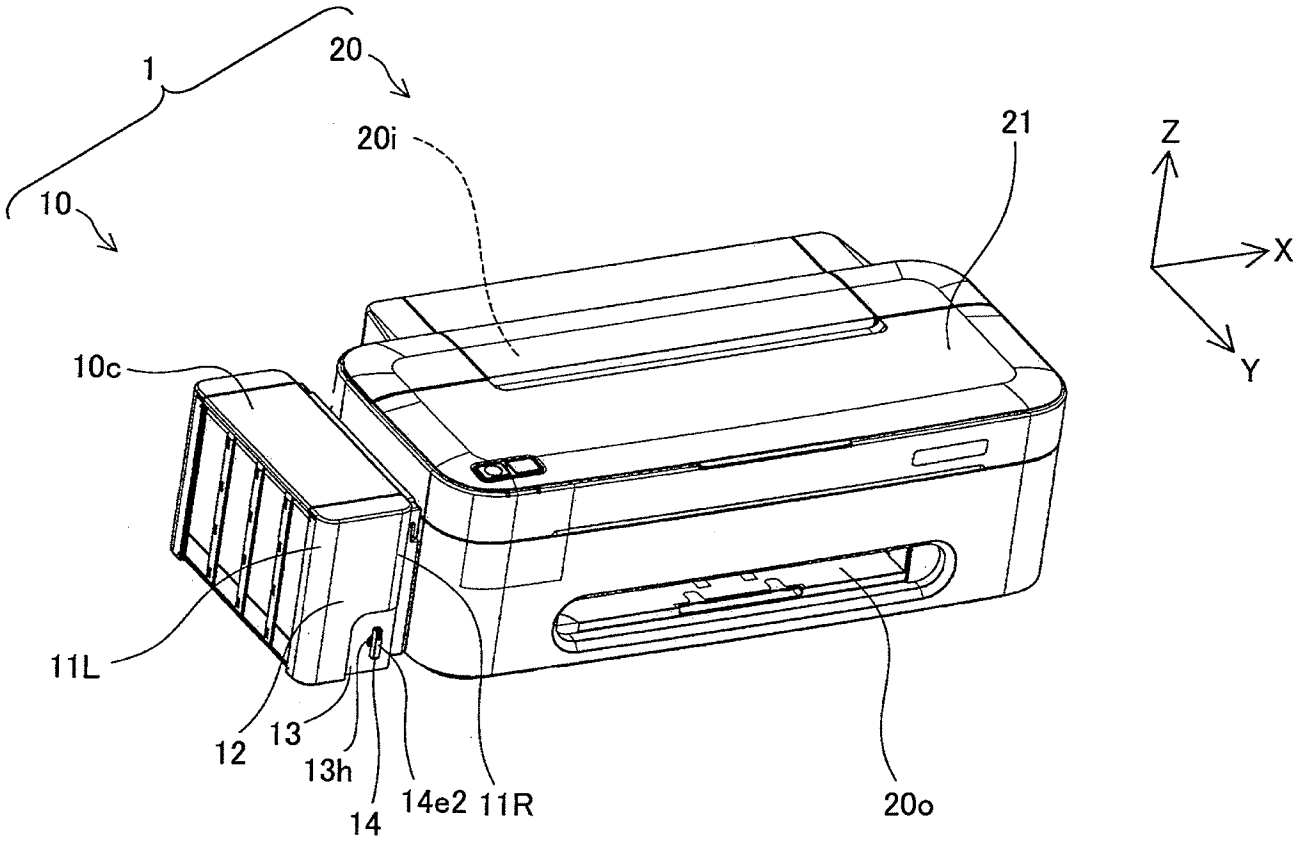
FIG. 1 is a perspective view showing the printing system 1 of an embodiment of the present invention.
Figure 2:
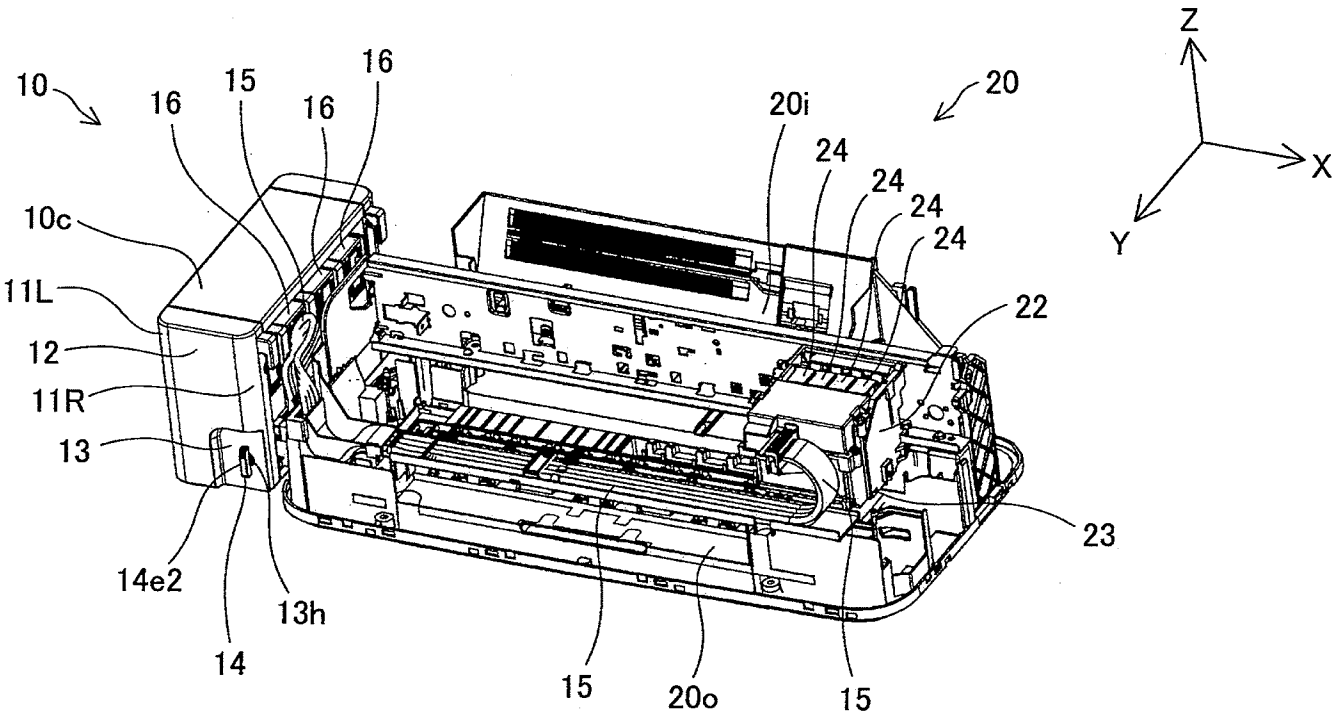
FIG. 2 is a perspective view showing the state with the case 21 of the printer unit 20 removed.

FIG. 1 is a perspective view showing the printing system 1 of an embodiment of the present invention. Note that in FIG. 1, the X axis, Y axis, and Z axis that are mutually orthogonal are shown to specify directions. The X axis, Y axis, and Z axis are also shown in FIG. 2 and thereafter. The X axis, Y axis, and Z axis shown in each drawing represent the same respective direction. In this specification, the Z axis positive direction is called "up." The Z axis negative direction is called "down." The X axis positive direction is called "right." The X axis negative direction is called "left." The Y axis positive direction is called "front." The X axis negative direction is called "back."

As shown in FIG. 1, the printing system 1 has an ink tank unit 10 and a printer unit 20. The ink tank unit 10 contains ink. The ink tank unit 10 is connected to the printer unit 20 via the hose 15 (not shown in FIG. 1), and supplies ink to the printer unit 20. The printer unit 20 jets that ink on the printing medium to execute printing. The printing medium on which the ink is jetted is delivered from the delivery port 20*o*. Note that in FIG. 1, the input port 20*i* for inputting the printing medium to the printer unit 20 is closed.

The side for which the printing medium is delivered from the delivery port 20*o* during printing execution is called the "front" of the printer unit 20. When the ink tank unit 10 is disposed in the orientation when supplying the ink to the printer unit 20, the side of the ink tank unit 10 matching the side (front) of the printer unit 20, at which there is the delivery port 20*o*, is called "front." The ink tank unit 10 and the printer unit 20 are placed in a consistent orientation. Specifically, the ink tank unit 10 is shown in an orientation when the ink is supplied from the ink tank unit 10 to the printer unit 20. In each drawing of this application, the "front" of the ink tank unit 10 and the printer unit 20 is the Y axis positive side.

Note that with this specification, unless specified explicitly, when describing directions such as up, down, left and right, X axis, Y axis, Z axis and the like, the assumption is that the ink tank unit 10 and the printer unit 20 are placed in the orientation when supplying ink from the ink tank unit 10 to the printer unit 20.

The ink tank unit 10 is equipped with a case 10*c* that covers its outside. More specifically, the case 10*c* covers the ink tank unit 10 X axis positive side, the Y axis positive side and negative side, and the Z axis positive side and negative side. The ink tank unit 10 X axis negative side (left side in FIG. 1) is not covered by the case 10*c*, and the internal structure is exposed.

The case 10*c* is equipped with a first plane part 12 on the front side (Y axis positive side). Also, the case 10*c* is similarly equipped with a second plane part 13 on the positive surface side. The second plane part 13 is the bottom right side part of the case 10*c* seen from the front. The second plane part 13 is a plane that is narrower than the first plane part 12. Of the front sides of the case 10*c*, the part other than the plane part 13 is constituted by the first plane part 12 and by the tilted parts 11R and 11L connected to the left and right ends of the first plane part 12. The tilted parts 11R and 11L are positioned at the boundary of the case 10*c* front part and the side part. The first plane part 12 and the second plane part 13 are parallel with a plane spanned by the Z axis and the X axis. However, the second plane part 13 is positioned more to the Y axis negative side than the first plane part 12.

A hole 13*h* is provided at roughly the center of the second plane part 13. Also, the ink tank unit 10 is equipped with a handle 14 connected to the interior through that hole 13*h*. The handle 14 is connected to a cam 173 (not shown in FIG. 1) provided on the interior of the ink tank unit 10 at the end part 14*e*1 of the Y axis direction negative side. When the handle 14 is rotated, the rotational motion is transmitted to the cam 173.

The handle 14 functions as the operating unit for stopping the supply of ink from the ink tank unit 10 to the printer unit 20. As shown in FIG. 1, the handle 14 is provided on the front side of the ink tank unit 10. Because of that, the handle 14 is easy for the viewer to see. Thus, the user is able to easily confirm whether the handle 14 is set in the proper position. Also, when it is necessary to stop supply of the ink from the ink tank unit 10 to the printer unit 20 in advance, e.g. when changing the installation location of the ink tank unit 10 and the printer unit 20, there is little possibility of the user forgetting to operate the handle 14.

The position along the Y axis direction of the end part 14*e*2 of the handle 14 Y in the axis direction positive side is further to the Y axis direction negative side than the first plane part 12. Specifically, the handle 14 is arranged at a position deeper overall than the first plane part 12. Because this kind of constitution is used with this embodiment, it is possible to make the outermost dimension of the ink tank unit smaller. Also, even when the ink tank unit 10 bumps into another structural object, or when the ink tank unit 10 is dropped during transport or the like, there is a higher possibility of the first plane part 12 bumping into another structure, the floor or the like rather than the handle 14. Because of this, there is a low possibility of impact from outside being conveyed to the internal structure of the ink tank unit 10 via the handle 14. Thus, there is little possibility of the ink tank unit 10 failing due to a collision with another member.

FIG. 2 shows the printing system 1 of an embodiment of the present invention, and is a perspective view showing the state with the case 21 of the printer unit 20 removed. The printer unit 20 is equipped with a carriage 22 for mounting a sub tank 24. A printing head 23 equipped with a plurality of nozzles is provided on the bottom surface (Z axis negative side surface) of the carriage 22. The carriage 22 is moved back and forth in the X axis direction by conveyance of the carriage motor drive force by a seamless belt. Of the back and forth movement process of the carriage 22, FIG. 2 shows the state when the carriage 22 is positioned at the right end seen from the front.

The sub tank 24 on the carriage 22 is connected to the ink containing unit 16 of the ink tank unit 10 by the elastically deformable hose 15. When ink is ejected from the printing head 23, the sub tank 24 supplies ink to the printing head. Also, the sub tank 24 supplies ink from the ink containing unit 16 of the ink tank unit 10 via the hose 15. Note that the ink containing unit 16 of the ink tank unit 10, the hose 15, the sub tank 24, and the printing head 23 are provided in 4 lines independently for each ink color. Specifically, the printing system 1 uses ink of the four colors cyan, magenta, yellow, and black.

Figure 3:
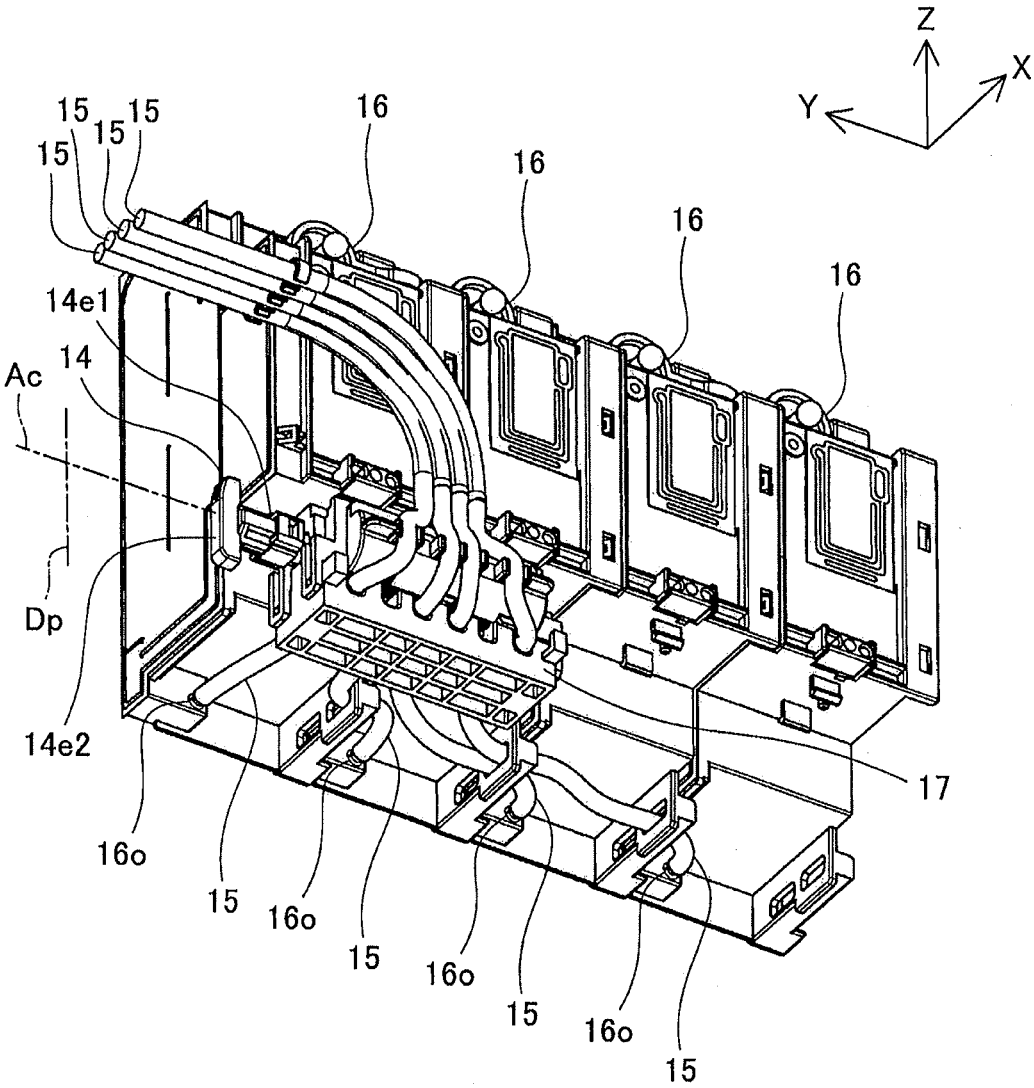
FIG. 3 is a perspective view of the internal structure of the ink tank unit 10 seen from the X axis positive, the Y axis positive, and the Z axis negative directions.

FIG. 3 is a perspective view of the internal structure of the ink tank unit 10 seen from the X axis positive, the Y axis positive, and the Z axis negative directions. The ink tank unit 10 is equipped with four ink containing units 16 that respectively contain cyan, magenta, yellow and black ink. Also, the ink tank unit 10 is equipped with an opening and closing unit 17 for stopping the supply of ink from the ink tank unit 10 to the printer unit 20.

At the bottom end of each ink containing unit 16 is provided a delivery part 16*o* for delivering ink within the ink containing unit 16. Four hoses 15 respectively receive cyan, magenta, yellow, and black ink from the ink containing units 16 and each ink is flowed therein. The other end of the hoses 15 are connected to the sub tanks 24 on the previously described carriage 22 (see FIG. 2). As shown in FIG. 3, the four hoses 15 connected to the delivery units 16*o* of the respective ink containing units 16 pass through the opening and closing unit 17, after which they are bundled and connected to the printer unit 20.

The end part 14*e*1 of the handle 14 in Y axis direction negative side is connected to the cam 173 (not shown in FIG. 3) inside the opening and closing unit 17. Note that when removing the case 10*c* from the ink tank unit 10, the handle 14 is removed in advance from the opening and closing unit 17.

However, in FIG. 3, the state with the handle 14 attached to the opening and closing unit 17 is shown to make the technology easy to understand.

Figure 4:
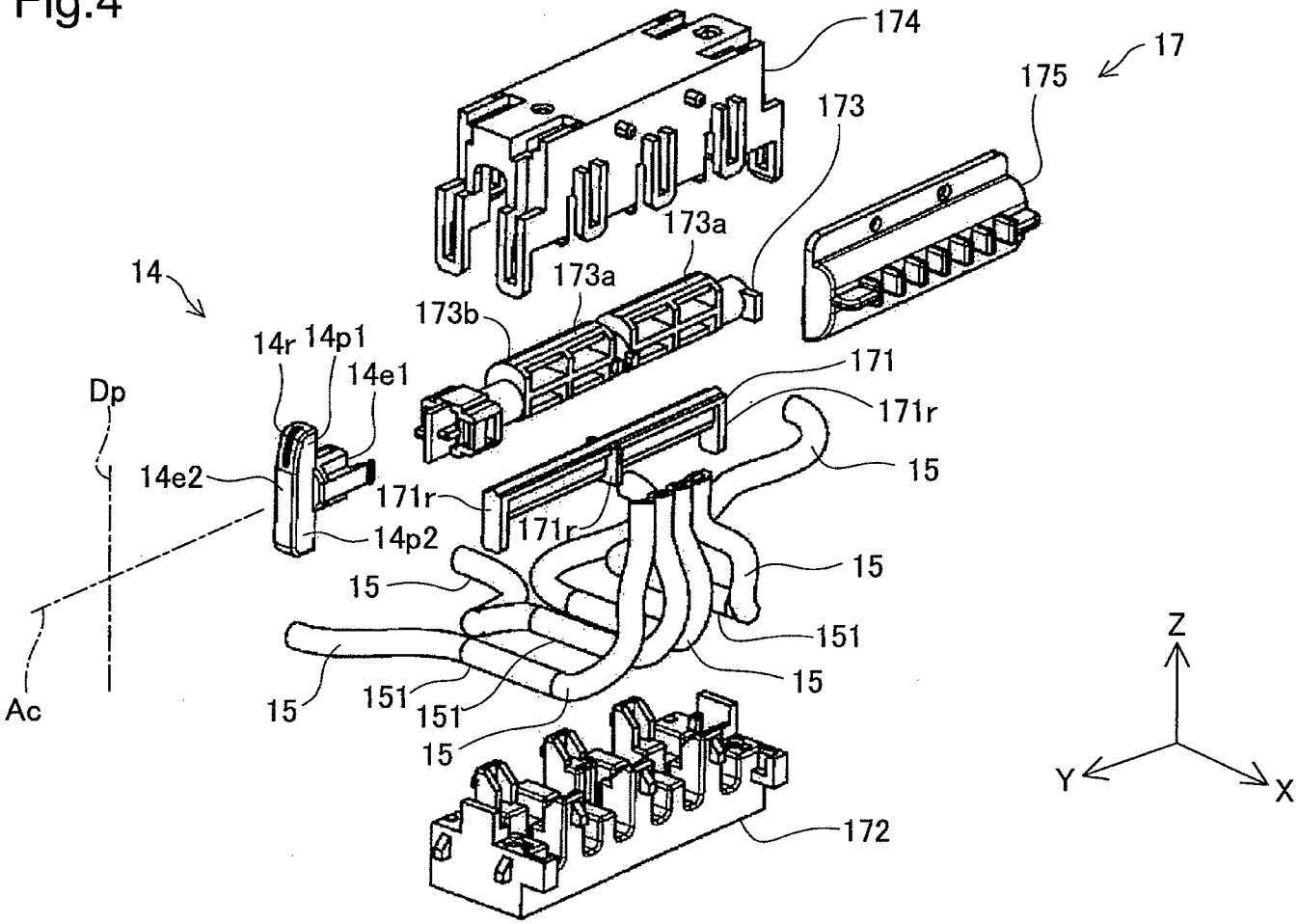
FIG. 4 is an exploded view of the opening and closing unit 17.

FIG. 4 is an exploded view of the opening and closing unit 17. FIG. 4 is a perspective view of each member constituting the opening and closing unit 17 seen from the X axis positive, the Y axis positive, and the Z axis positive directions. The opening and closing unit 17 is equipped with a slider 171, a support member 172, a cam 173, and members 174 and 175. Note that the handle 14 is also a part of the opening and closing unit 17.

The slider 171 is a generally plate-like member having ribs 171*r* at both ends and at the center. The slider 171 is arranged on the four hoses 15 that pass through the inside of the opening and closing unit 17 so as to be able to move perpendicularly in relation thereto. The support member 172 is fixed to the frame of the ink tank unit 10, and this supports the other members of the opening and closing unit 17, as well as the hoses 15 that pass through the inside of the opening and closing unit 17. The slider 171 and the support member 172 are disposed sandwiching the hoses 15 that pass through the inside of the opening and closing unit 17.

The hose 15 has an elastic portion 151 that can be elastically deformed and flattened. The hose 15 is arranged such that the elastic portion 151 is positioned between the slider 171 and the support part 172 within the opening and closing unit 17. The elastic portion 151 of the hose 15 has a two layer structure. The inside layer of the elastic portion 151 is constituted using EPDM (ethylene propylene diene Monomer (M-class) rubber). The outside layer of the elastic portion 151 is constituted by silicone rubber.

The cam 173 is supported rotatably, sandwiched from the top and bottom directions by the support member 172 and the member 174. In the drawing, the cam 173 rotation axis direction is shown as Ac. The cam 173 rotation axis direction Ac matches the Y axis direction in the orientation when supplying ink from the ink tank unit 10 to the printer unit 20. Thus, the cam 173 determines the Z axis direction position of the slider 171 by its rotation position. Note that the handle 14 rotation axis direction matches the cam 173 rotation axis direction Ac. Also, the cam 173 rotation axis direction Ac and the handle 14 rotation axis direction are perpendicular to the first plane part 12.

The member 175 is attached to the member 174. The member 175 holds the four hoses 15 that pass through the support member 172 at a specified position (see FIG. 3). The four hoses 15 are bundled after passing through the member 175.

The handle 14 has parts 14*p*1 and 14*p*2 projecting in the direction Dp perpendicular to the cam 173 rotation axis direction Ac. Following, the part 14*p*1 is called the "first part 14*p*1," and the part 14*p*2 is called the "second part 14*p*2." A recess 14*r* which becomes a guide mark when the user is trying to understand the rotation position of the handle 14 is provided on the first part 14*p*1.

As shown in FIG. 4, the handle 14 is provided as a separate member from the cam 173. Because of this, when manufacturing the ink tank unit 10, the handle 14 sandwiches the second plane part 13 of the case 10*c* of the ink tank unit 10, and is connected to the cam 173 from the opposite side. Note that of the handle 14, the part connected to the cam 173 is provided in a size that can pass through the hole 13*h*.

When the handle 14 and the cam 173 are provided as an integrated unit, to manufacture the ink tank unit 10, it is necessary to provide the second plate part 13 of the case 10*c* as two members divided by the line that passes through the hole 13*h*. Then, it is necessary to sandwich and hold the handle and cam provided as an integrated unit using those two members. At that time, on the inside of the case 10*c*, it is necessary to assemble the other slider 171, the support member 172, the cam 173, and the members 174 and 175 with the cam at the center. It is also necessary to provide structures such as a recess and a convex part to fix the two members that constitute the second plane part 13 to each other.

However, with this embodiment, the handle 14 and the cam 173 are provided as separate members. Because of this, the support member 172, the cam 173, and the members 174 and 175 arranged inside the case 10*c* are assembled in sequence from the bottom, and after that, the case 10*c* positive surface side part provided as an integrated unit is attached, and furthermore, it is possible to attach the handle 14 via the hole 13*h* from outside the case 10*c* (second plate part 13). Specifically, it is easy to assemble the ink tank unit 10.

Also, with this embodiment, because the handle 14 and the cam 173 are provided as separate members, it is possible to provide the second plate part 13 of the case 10*c*, which is penetrated by the handle 14 or the cam 173, as an integrated unit. Because of that, it is possible to improve the appearance of the front side of the ink tank unit 10. Furthermore, because it is possible to reduce the number of members constituting the case 10*c*, it is possible to provide a more robust case 10*c* which is easily impacted from outside.

Figure 5:
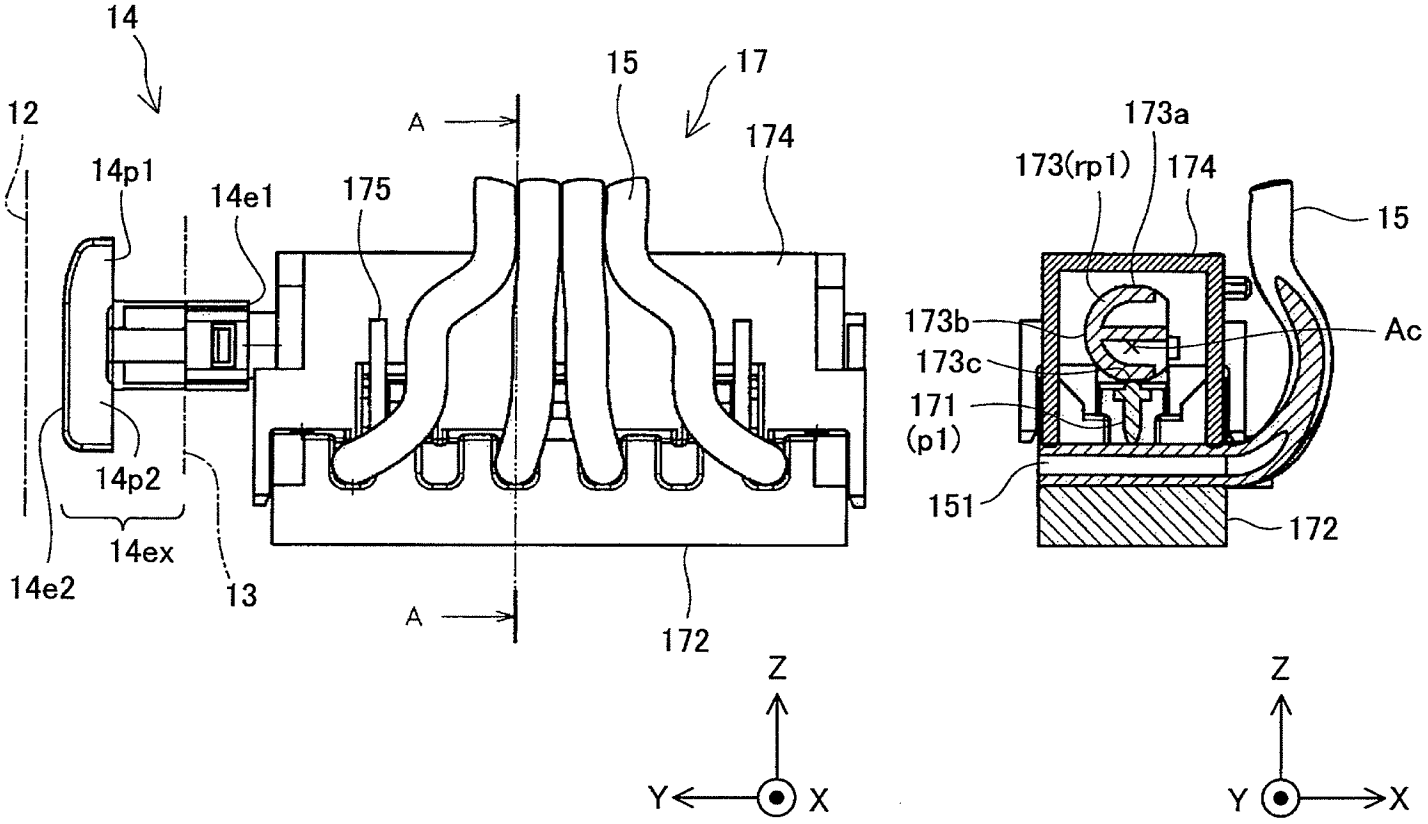
FIG. 5 shows the handle 14 state and the hose 15 state when the rotation position of the cam 173 is at the first rotation position.

FIG. 5 shows the state of the handle 14 and the state of the hose 15 when the cam 173 rotation position is at the first rotation position rp1. A side view of the opening and closing unit 17 is shown at the left side of FIG. 5. An A-A cross sectional view of the left side view is shown at the right side of FIG. 5. The cam 173 is equipped with two planes 173*a* and 173*c* arranged sandwiching the rotation axis Ac, and a curved surface 173*b* having a roughly semicircular cross section that connects these two planes 173*a* and 173*c*.

The planes 173*a* and 173*c* of the cam 173 are both parallel to the rotation axis Ac, and are parallel to each other. The curved surface 173*b* is parallel to the rotation axis Ac, and is a curved surface that is convex from the rotation axis Ac toward the outside. There is a ridge line (corner) that is parallel to the rotation axis Ac at the boundary of the plane 173*a* and the curved surface 173*b*. There is also a ridge line (corner) that is parallel to the rotation axis Ac at the boundary of the plane 173*c* and the curved surface 173*b*. Note that the rotation axis Ac is at a position closer to the plane 173*c* than the plane 173*a* in the direction perpendicular to the planes 173*a* and 173*c*.

When the first part 14*p*1 of the handle 14 is facing upward (Z axis positive direction), the cam 173 rotation position is in the rotation position shown at the right side of FIG. 5. This rotation position is called the "first rotation position rp1." At this time, the slider 171 is between the four hoses 15 that pass through the inside of the opening and closing unit 17 and the cam 173, and is supported by the four hoses 15. Also, there is almost no elastic deformation of the four hoses 15. Note that at this time, the planes 173*a* and 173*c* of the cam 173 are parallel to the X axis and the Y axis. Also, the slider 171 is in contact with the plane 173*c* of the cam 173. The position of the slider 171 at this time is called the "first position p1." When the slider 171 is at the first position p1, the ink can flow inside the four hoses 15 at the opening and closing unit 17.

Figure 6:
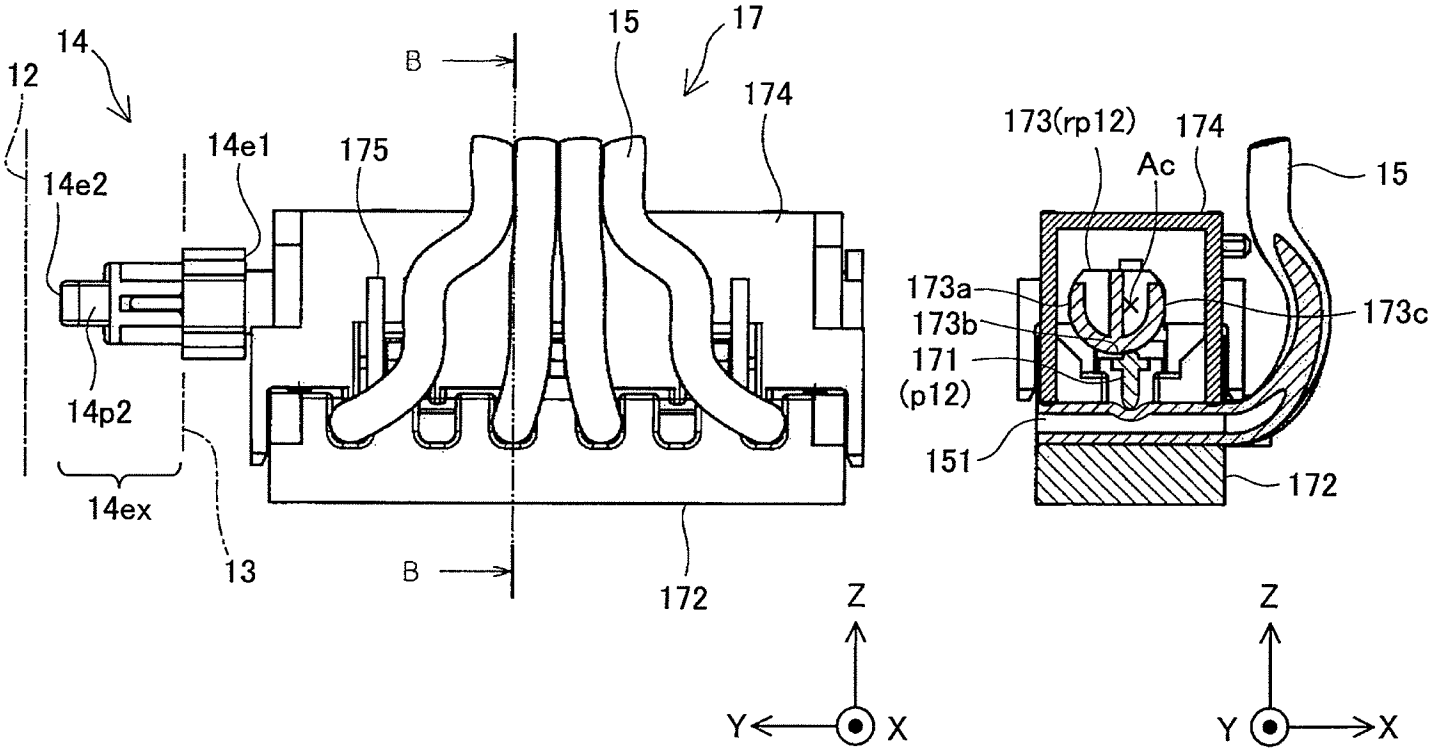
FIG. 6 shows the handle 14 state and the hose 15 state when the cam 173 is in a transition state.

FIG. 6 shows the handle 14 state and the hose 15 state when the cam 173 is in the transition state rp12. A side view of the opening and closing unit 17 is shown at the left side of FIG. 6. A B-B cross sectional view of the left side view is shown at the right side of FIG. 6.

When the handle 14 is rotated counterclockwise 90 degrees from the state shown in FIG. 5, and the handle 14 first part 14*p*1 is facing left (X axis negative direction), the cam 173 rotation position is at the rotation position rp12 shown at the right side of FIG. 6. At this time, the slider 171 is pushed out by the cam 173, and cuts into the four hoses 15 that pass through the inside of the opening and closing unit 17. Also, portions of the top parts of the four hoses 15 are elastically deformed. When the slider 171 is at the position p12 shown in FIG. 6, the ink can still flow inside the four hoses 15 at the opening and closing unit 17. Note that when the cam 173 is at the rotation position rp12, the slider 171 is in contact with the curved surface 173*b* of the cam 173. As shown in FIG. 6, at this time, the slider 171 is in contact with the cam 173 with the part slightly to the right side from the lowest part of the cam 173 that is in the rotation position rp12.

Figure 7:
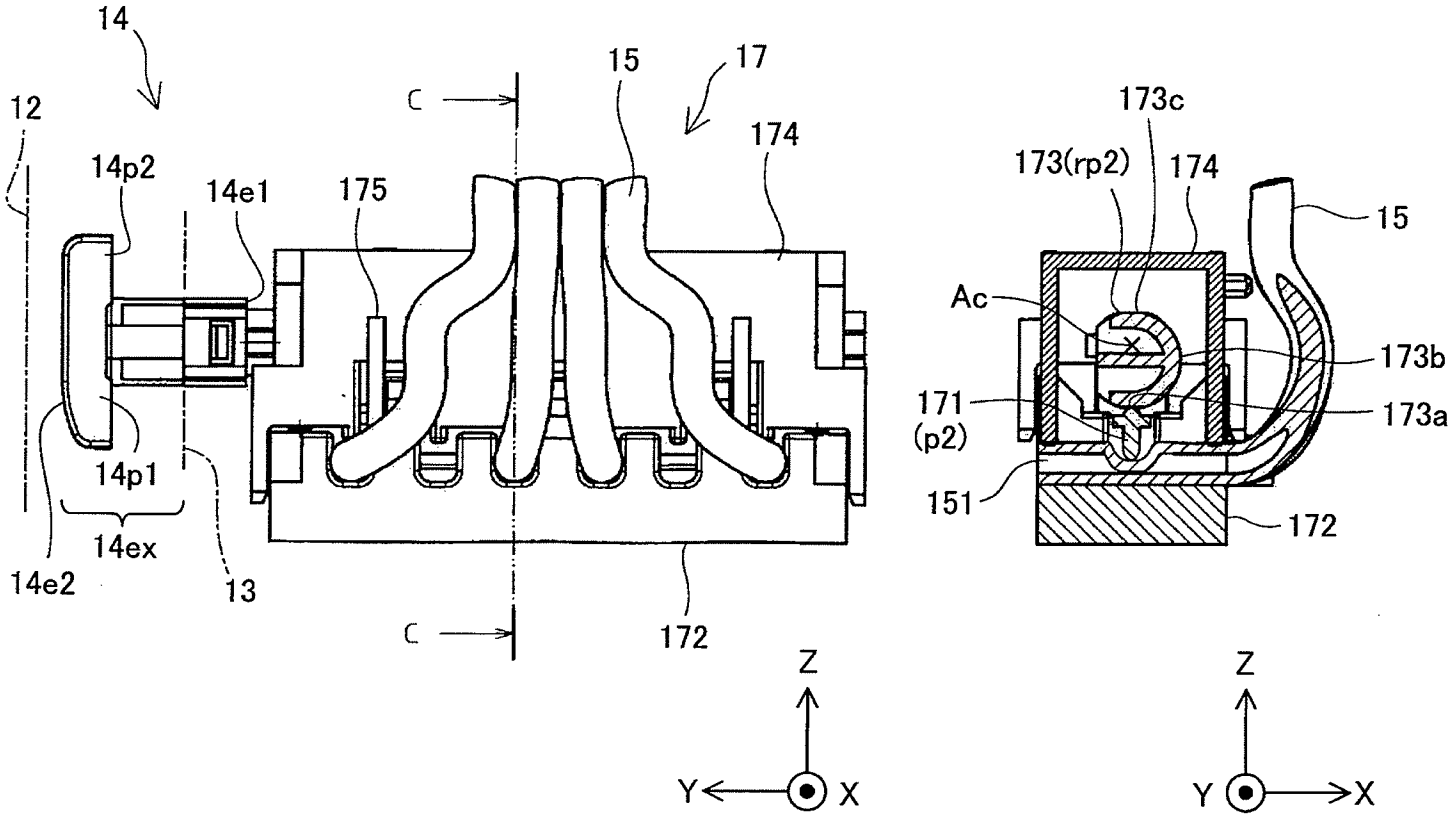
FIG. 7 shows the handle 14 state and the hose 35 state when the rotation position of the cam 173 is at the second rotation position.

FIG. 7 is a drawing showing the handle 14 state and the hose 15 state when the cam 173 rotation position is at the second rotation position rp2. A side view of the opening and closing unit 17 is shown at the left side of FIG. 7. A C-C cross sectional view of the left side view is shown at the right side of FIG. 7.

When the handle 14 rotates 180 degrees counterclockwise from the state in FIG. 5, and the handle 14 first part 14*p*1 is facing downward (Z axis negative direction), the cam 173 rotation position is in the rotation position shown at the right side of FIG. 7. The cam 173 rotation position shown at the right side of FIG. 7 is 180 degrees different from the cam 173 rotation position shown at the right side of FIG. 5. At this time, the slider 171 is pushed out by the cam 173, and the four hoses 15 that pass through the inside of the opening and closing unit 17 are flattened. Also, the four hoses 15 contact the top surface and the bottom surface among the inner surfaces in a specified section. The position of the slider 171 at this time is called the "second position p2." When the slider 171 is at the second position p2, the ink cannot flow inside the four hoses 15 at the opening and closing unit 17. Note that at this time, the planes 173*a* and 173*c* of the cam 173 are parallel to the X axis and the Y axis. Also, the slider 171 is in contact with the plane 173*a* of the cam 173.

When the handle 14 rotates 180 degrees clockwise from the state in FIG. 7 and the handle 14 first part 14*p*1 faces upward (Z axis positive direction) as shown in FIG. 5, the elastic force of the elastic portions 151 of the four hoses 15 is what pushes the slider 171 back from the second position p2 to the first position p1.

When the cam 173 is in the second rotation position rp2 (see FIG. 7), the slider 171 is pressed by the plane 173*a* provided on the cam 173. When the cam 173 is moved from the second rotation position rp2 to the first rotation position rp1 (see FIG. 5), the contact point of the cam 173 and the slider 171 moves from the plane 173*a* to the curved surface 173*b* (see FIG. 6).

The slider 171 is positioned at the bottommost direction when the contact point of the cam 173 and the slider 171 is positioned at the boundary of the plane 173*a* and the curved surface 173*b* (end of plane 173*a*). When moving the cam 173 from the second rotation position rp2 (see FIG. 7) to the first rotation position rp1 (see FIG. 5), the slider 171 is moved to the upward direction by the restoring force of the hose 15 after being pressed and moved downward once by the end part of the plane 173*a* of the cam 173. Specifically, to move the cam 173 from the second rotation position rp2 (see FIG. 7) to the first rotation position rp1 (see FIG. 5), it is necessary to press the slider 171 downward once in resistance to the elastic force of the hose 15. Because of this, it is necessary to give rotational force of a designated value or greater to the cam 173. Thus, when the cam 173 is at the second rotation position rp2, it is possible to prevent unintended movement to the first rotation position rp1 due to impact such as vibration or dropping or the like during transport.

Meanwhile, when the user operates the handle 14 and changes the cam 173 from the first rotation position rp1 (see FIG. 5) to the second rotation position rp2 (see FIG. 7), the rotation direction operating force changes at the boundary of the curved surface 173*b* and the plane 173*a* when the contact point of the cam 173 and the slider 171 is moved from the curved surface 173*b* to the plane 173*a*. Because of this, the user is able to sense a click feeling directly before the cam 173 reaches the second rotation position rp2 (see FIG. 7), and can intuitively sense the fact that the handle 14 is in the proper position.

With the ink tank unit 10 of this embodiment, when performing printing using the printer unit 20, the handle 14 is operated in the state shown in FIG. 5, the cam 173 is put in the first rotation position rp1, and it is possible to supply each ink from the ink tank unit 10 to the printer unit 20.

Also, when moving the printer unit 20 and the ink tank unit 10 or the like, when there is the possibility that the ink tank unit 10 will be positioned higher than the nozzle of the printing head 23 of the printer unit 20, it is possible to operate so that the handle 14 is in the state in FIG. 7 in advance, and to have the cam 173 be in the second rotation position rp2. In that state, all of the ink is not supplied from the ink tank unit 10 to the printer unit 20. Because of this, even if the ink tank unit 10 is positioned higher than the nozzle of the printing head 23 of the printer unit 20, ink does not leak from the nozzle of the printing head 23.

Also, with this embodiment, an elastic portion 151 is provided on the hose 15, and the functions noted above are achieved by pushing out the slider 171 in relation to the elastic portion 151 with the cam 173. Specifically, with this embodiment, it is possible to achieve the functions noted above with a simple structure and inexpensively.

Furthermore, with this embodiment, the inside layer of the elastic portion 151 is constituted by EPDM. Also, the outside layer of the elastic portion 151 is constituted by silicone rubber. EPDM is excellent in terms of gas barrier properties, so it is possible to suppress the moisture in the ink from being transmitted through the hose 15 and evaporating. Also, because these adhere well to each other when they are flattened, when the elastic portion 151 is flattened by the slider 171 and the support member 172 (see FIG. 7), the ink does not flow out easily. Meanwhile, the silicone rubber is not as excellent in terms of gas barrier properties as the EPDM. However, the silicone rubber has better restoring ability after flattening than the EPDM (see FIG. 5).

Because of this, with this embodiment, with a two layer structure using two materials having different characteristics such as noted above, it is possible to attain the kinds of effects noted below for the elastic portion 151 of the hose 15. Specifically, it is possible to attain a high level of (i) suppression of evaporation of moisture in the ink for the elastic portion 151, (ii) prevention of ink leaking when stopping supply of ink (see FIG. 7), and (iii) ensuring the ink supply performance when restarting the ink supply (see FIG. 5).

In FIG. 5 to FIG. 7, the position of the case 10*c* first plane part 12 and the second plane part 13 are shown by dot-dash lines. As shown in FIG. 5 to FIG. 7, the position along the Y axis direction of the end part 14*e*2 of the handle 14 in Y axis direction positive side is at a position more to the Y axis direction negative side than the first plane part 12, specifically, closer to cam 173 (because it is covered by member 174, it is not shown in FIG. 5 to FIG. 7). Because of this, as described previously, when the ink tank unit 10 bumps into other structural objects or the ink tank unit 10 is dropped during transport, there is little possibility of impact from outside being conveyed to the internal structure of the ink tank unit 10 via the handle 14.

Note that the ink tank unit 10 of this embodiment correlates to the "liquid supply device" in the SUMMARY. The printer unit 20 of this embodiment correlates to the "liquid jetting device." The ink containing unit 16 of this embodiment correlates to the "liquid containing chamber." The hose 15 of this embodiment correlates to the "tube." The slider 171 of this embodiment correlates to the "first member." The support member 172 of this embodiment correlates to the "second member." The cam 173 of this embodiment correlates to the "cam."

Of the handle 14 of this embodiment, the part 14*ex* exposed to the outside of the second plane part 13 (see FIG. 5 to FIG. 7) correlates to the "operating unit" in the SUMMARY. The "front" of this embodiment correlates to the "side at which the liquid jetting device delivers the object on which the liquid is jetted." The first plane part 12 of this embodiment correlates to the "first part." The second plane part 13 of this embodiment correlates to the "second part." The printing system 1 of this embodiment correlates to the "liquid jetting system."

B. Variations

Note that the present invention is not limited to the aforementioned embodiments and modes of embodiment, and it is possible to implement this in various modes within a range that does not stray from the key points, for example, variations such as the following are possible.

B1. Variation 1

With the embodiment noted above, the slider 171 that flattens the elastic portion 151 of the hose 15 together with the support member 172 is a plate-like member. However, it is also possible to use a different mode for the member that flattens the hose as the transport tube. For example, it is also possible to use a mode for which the part that faces the tube is a plane. It is also possible to use a mode for which the part that faces the tube is divided in two parts. Specifically, as long as the first member for flattening the tube is close to the second member, the elastic portion of the tube is flattened, and the flow of liquid inside the elastic portion of the tube can be prevented, any mode can be used. However, it is preferable that the first member and the second member be constituted by materials with higher Young's moduli than the elastic portion of the tube.

Also, with the embodiment noted above, the set of the slider 171 and the support member 172 flattens the elastic portions 151 of all the hoses 15, and the flow of ink is stopped for all of the hoses 15. However, it is also possible to equip a plurality of sets of the slider 171 as the first member and the support member 172 as the second member, and to allocate between these to stop the flow of liquid for a plurality of tubes. It is also possible to use a combination of one first member and a plurality of second members to stop the flow of liquid within the tubes. Furthermore, it is also possible to use a combination of a plurality of first members and one second member to stop the flow of liquid within the tubes.

B2. Variation 2

With the embodiment noted above, the cam 173 pushes out only the slider 171 facing the elastic portion 151 of the hose 15. However, it is also possible to use a mode whereby the cam, which determines the position of the slider 171 as the first member that flattens the tube, in addition to the first member, also moves the second member arranged at the reverse side of the first member sandwiching the tube.

Also, with the embodiment noted above, the cam that determines the position of the slider 171 as the first member that flattens the tube directly presses the first member. However, it also possible to use a mode for which the cam moves the first member or the second member via other members that can transmit displacement or force, such as a link or belt, spring, gear, another cam or the like.

Specifically, it is possible to use various modes as long as it is a mode whereby in a specified rotation position, the cam arranges the first member and the second member in specified relative positions, and as a result, it is possible to flatten the tube and make it so that liquid cannot flow.

B3. Variation 3

With the embodiment noted above, the elastic portion of the hose 15 has a two layer structure of silicone rubber and EPDM. However, the part of the tube flattened by the first and second member can also use a different structure.

However, it is preferable that, for the part of the tube flattened by the first and second members, a material or materials be used that flattens and for which the inner surface adheres more easily than the other parts, and as a result, more easily stops the flow of liquid. Also, it is preferable to use a material or materials which more easily return to its original shape than other parts when the external force flattening the concerned part is removed. Also, it is preferable that the part of the tube has a part provided using the first material and a part provided using the second material, and the first material is a material that flattens and for which the inner surface adheres more easily than the second material, and the second material is a material that more easily returns to its original shape than the first material when the external force flattening the concerned part is removed.

B4. Variation 4

With the embodiment noted above, the operating unit and the cam are directly connected. Also, with the embodiment noted above, the handle 14 is connected to the cam 173 such that its rotation axis matches to rotation axis Ac of the cam 173. However, it is also possible to have the rotation axis of the handle 14 as the operating unit not match the cam rotation axis. It is also possible to have the operating unit and the cam not be connected directly. For example, it is also possible to have the operating unit and the cam be connected via another member that can transmit displacement or force, such as a link or belt, a spring, gear, another cam or the like. For example, it is also possible to use a mode whereby the operating unit is connected to the cam so as to be able to convert displacement to rotational motion and transmit it. However, it is preferable that the operating unit and the cam be connected so that it is possible for the rotational motion to be transmitted from the operating unit to the cam.

Furthermore, it is possible to use a mode for which the operating unit is not mechanically connected to the cam, for example whereby the cam is connected to a motor, and the operating unit is electrically connected to a motor for controlling the motor.

B5. Variation 5

With the embodiment noted above, in the orientation when ink is supplied from the ink tank unit 10 to the printer unit 20, the handle 14 as the operating unit is provided at the same side as the delivery port 20*o* of the printer unit 20, specifically, at the front. However, the operating unit can also be provided on the liquid supply device at a side other than the front.

Also, with the embodiment noted above, the handle 14 has two parts 14*p*1 and 14*p*2 that project along the direction Dp perpendicular to the cam 173 rotation axis direction Ac. However, it is also possible to use another mode for the handle 14 as the operating unit. For example, it is also possible to have a part projecting in three or more directions perpendicular to the rotation axis direction. It is also possible to have a part that projects equally in all directions, specifically, in a circle. Specifically, it is acceptable as long as the operating unit is equipped with a portion that is exposed to the outside of the liquid supply device, and projects in the direction perpendicular to its rotational axis.

B6. Variation 6

With the embodiment noted above, the first plane part 12 is perpendicular to the cam 173 rotation axis direction Ac. However, it is also possible to have the normal direction of the first plane part and the cam rotation axis direction not match.

Also, with the embodiment noted above, the first plane part 12 as the first part is a plane. However, the first part can also include a curved surface at least at one part. The first part which is a "plane" can also have thickness direction displacement of ⅕ or less of the lateral direction dimension and ⅕ or less of the vertical direction dimension. With such a mode, the plane that best matches the surface shape of the first part is determined using the least squares method, and the direction perpendicular to that plane is a direction perpendicular to the first part.

B7. Variation 7

With the embodiment noted above, the part provided with the hole 13*h* by which the cam and operating unit are connected is the second plane part 13. However, the part provided with the hole by which the cam and operating unit are connected can also use a mode that is not a plane, such as being indented in a spherical surface shape.

Furthermore, with the embodiment noted above, in the direction perpendicular to the first plane part 12, the second plane part 13 for which the handle 14 is provided as the operating unit is positioned more to the internal structure side of the ink tank unit 10 such as the cam 173 than the first plane part 12 is. Also, in the direction perpendicular to the first plane part 12, the position of the end part 14*e*2 (top part) of the handle 14 is more to the side of the internal structure of the ink tank unit 10 than the first plane part 12 is.

However, of the outer shell of the ink tank unit 10 as the liquid supply device, the part at which the operation unit is provided does not have to be positioned more to the internal structure side of the ink tank unit 10 than the first plane part 12 in the direction perpendicular to the first plane part 12. Also, in the direction perpendicular to the first plane part 12, the position of the end part 14*e*2 of the handle 14 does not have to be more to the side of the internal structure of the ink tank unit 10 than the first plane part 12. For example, it is also possible to arrange the operating unit at the first plane part 12.

B8. Variation 8

FIG. 8 through FIG. 12 show the opening and closing unit 37 and the handle 34 of liquid supply device according to variation 8. With the first embodiment, by the users operation of the handle 14 for rotating the cam 173, the slider 171 is moved in the Z axis direction (see FIG. 5 to FIG. 7). In contrast to this, with this variation, the slider 371 is moved in the Z axis direction by moving the handle 34 in the Z axis direction without going via the cam.

The opening and closing unit 37 of variation 8 is not equipped with a cam 173 and a handle 14 connected to the cam 173. Instead of those structures, the opening and closing unit 37 of variation 8 is equipped with a locking pin 371*e* provided at one end of the slider 371, a handle 34 connected to the other end of the slider 371 via a connecting shaft 371*p*, as well as bearings 372*e* and 374*e* equipped respectively with support member 372 and member 374 and supporting the locking pin 371*e*. The other points of variation 8 are the same as the embodiment.

Figure 8:
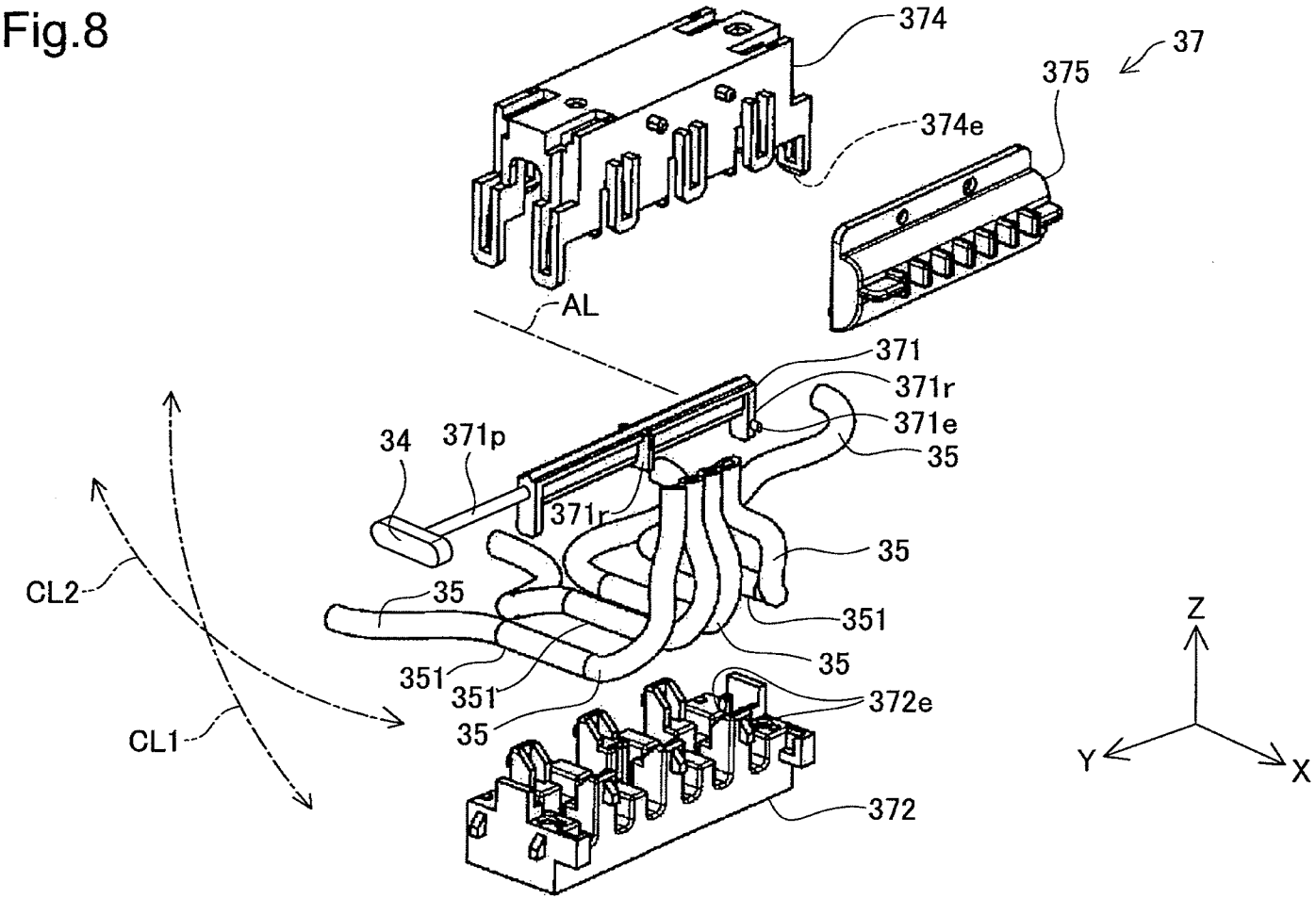
FIG. 8 is an exploded view of the opening and closing unit 37 of a variation.

FIG. 8 is an exploded view of the opening and closing unit 37 of variation 8. Of each structural element of the opening and closing unit 37, structural elements having the corresponding structural elements among structural elements of the opening and closing unit 17 of the embodiment are given code numbers corresponding to the code numbers given to the corresponding structural elements in the embodiment. Specifically, the code number for which the first digit "1" of the code number given to the corresponding structural element in the embodiment has replaced with "3" are given to the structural element of the opening and closing unit 37. Of the structural elements of the opening and closing unit 37, explanations are omitted for items having the same structure and functions as the corresponding structural elements in the opening and closing unit 17 of the embodiment to make the technology easier to understand.

The locking pin 371*e* is provided at one end of the slider 371. The bearing 372*e* which accepts and supports the locking pin 371*e* is provided on the support member 372. The bearing 374*e* which accepts the locking pin 371*e* is provided on the member 374 combined with the support member 372.

The locking pin 371*e* is supported to be able to rotate, sandwiched from the top and bottom directions by the bearing 372*e* in the support member 372 and the bearing 374*e* in the member 374 (see arrow CL1). The rotation axis direction of the rotation CL of the locking pin 371*e* is shown as AL in the drawing. The rotation axis direction AL of the locking pin 371*e* matches the X axis direction in the orientation when ink is supplied from the ink tank unit 10 to the printer unit 20. The Z axis direction position of the slider 371 is determined by the rotation position of rotation with the rotation axis AL as the center. Note that, in the same was as the embodiment, the hose 35 is arranged such that the elastic portion 352 is positioned between the slider 371 and the support member 372.

Also, the locking pin 371*e* is supported on the bearing 372*e* and the bearing 374*e* so as to be able to rotate even around the Z axis (see arrow CL2). The range of the angle at which the locking pin 371*e* can rotate around the Z axis is smaller than the range of the angle at which the locking pin 371*e* can rotate around the X axis.

The handle 34 is connected via the connecting shaft 371*p* to the other end of the slider 371. The same as with the handle 14 of the embodiment, the handle 34 is arranged at the front side of the outside of the case 10*c* of the ink tank unit 10 (see FIG. 1 and FIG. 2). The connecting shaft 371*p* is arranged such that it passes through the guide hole 33*h* provided on the second plane part 33 of the case 10*c* of the ink tank unit 10. The second plane part 33 is a structure corresponding to the second plane part 13 of the embodiment, and is positioned further to the Y axis negative side than the first plane part 32. The connecting shaft 371*p* connects the handle 34 positioned at the outside of the case 10*c* and the slider 371 positioned inside. The handle 34 functions as the operating unit for stopping the supply of ink from the ink tank unit 10 to the printer unit 20.

Figure 9:
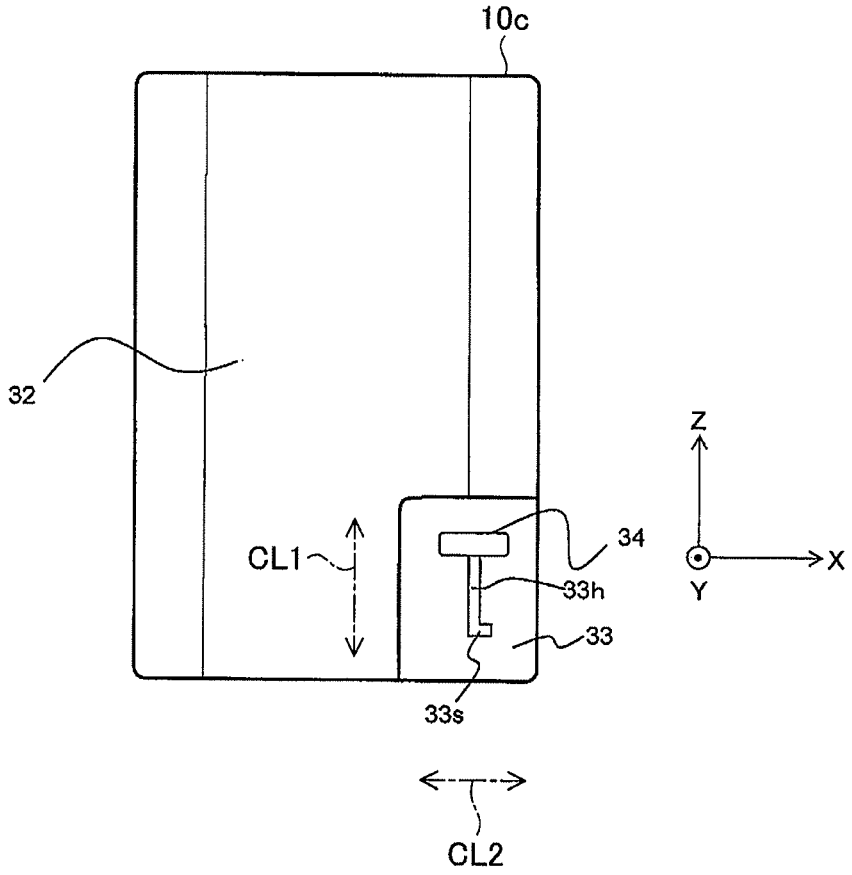
FIG. 9 shows the handle 34 position of a variation when the slider 371 is at the first position p31.

FIG. 9 is a front view of the case 10*c* of variation 8. The guide hole 33*h* that the connecting shaft 371*p* passes through is provided in a longer shape in the Z axis direction than the X axis direction. Then, the guide hole 33*h* has a locking part 33*s* that extends in the X axis positive direction on its bottom end. By the user's up and down (Z axis direction) operation of the handle 34, the connecting shaft 371*p* moves up and down within the guide hole 33*h* (see arrow CL1). As a result, inside the case 10*c*, the slider 371 connected to the connecting shaft 371*p* rotates up and down with the locking pin 371*e* as the center (see FIG. 8). The arrow CL1 in FIG. 8 and FIG. 9 expresses the rotation direction of the handle 34, the connecting shaft 371*p*, and the slider 371 with the locking pin 371*e* as the center.

Figure 10:
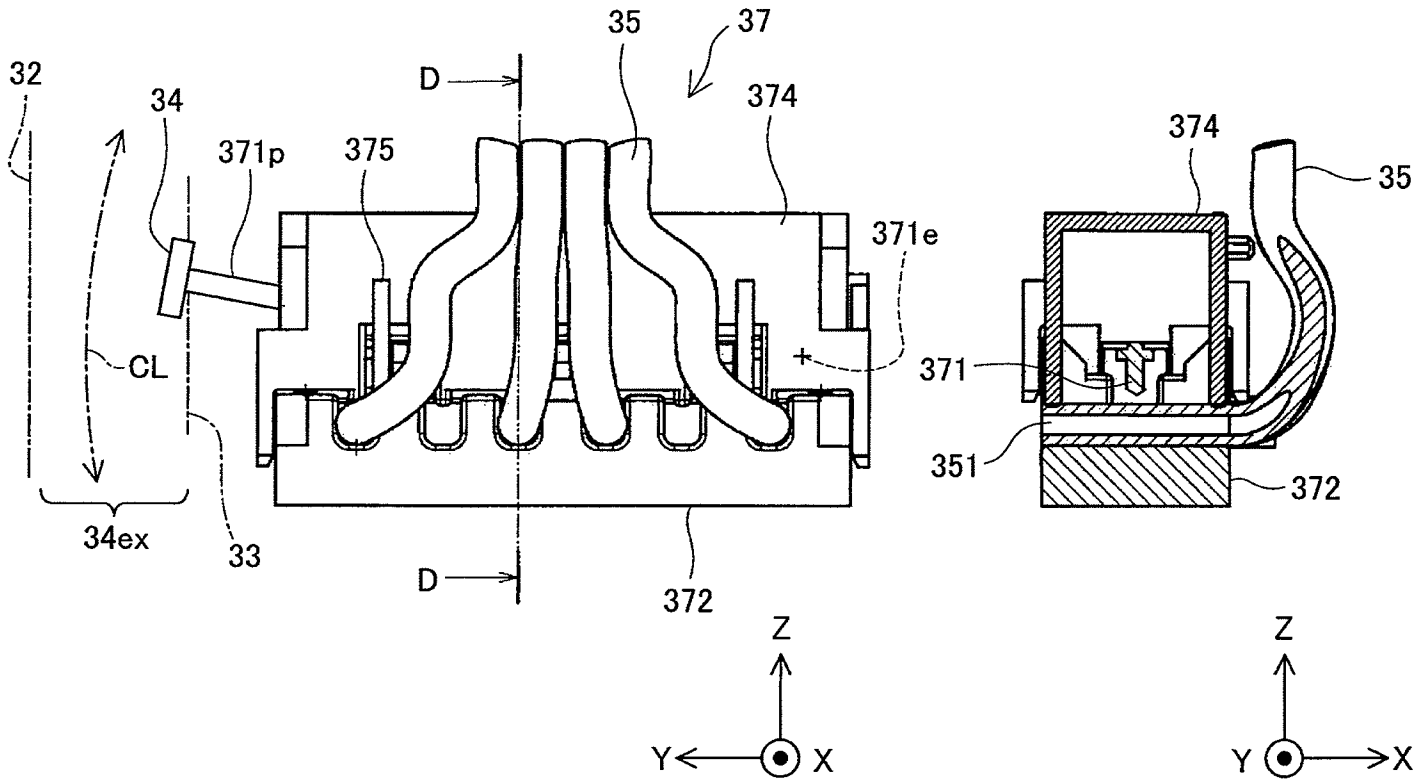
FIG. 10 shows the handle 34 state and the hose 35 state of a variation when the slider 371 is at the first position p31.

FIG. 10 is a drawing showing the orientation of the handle 34 in relation to the opening and closing unit 37 and the state of the hose 35 when in the position shown in FIG. 9. A side view of the opening and closing unit 37 is shown at the left side of FIG. 10. The D-D cross section of the left side view is shown at the right side of FIG. 10. When the handle 34 is in the position of FIG. 9, the slider 371 is supported by the four hoses 35 as shown in the right side of FIG. 10. Also, the four hoses 35 have almost no elastic deformation. Note that when the slider 171 is in the position of FIG. 10 (called "first position p31"), the ink can flow inside the four hoses 35 at the opening and closing unit 37. Specifically, the slider 371 is stored in the opening and closing unit 37 in an orientation such that the flow is not blocked for any of the hoses 35. Note that at this time, the slider 371 and the connecting shaft 371*p* are in a state tilted in relation to the Y axis or the Z axis.

Figure 11:
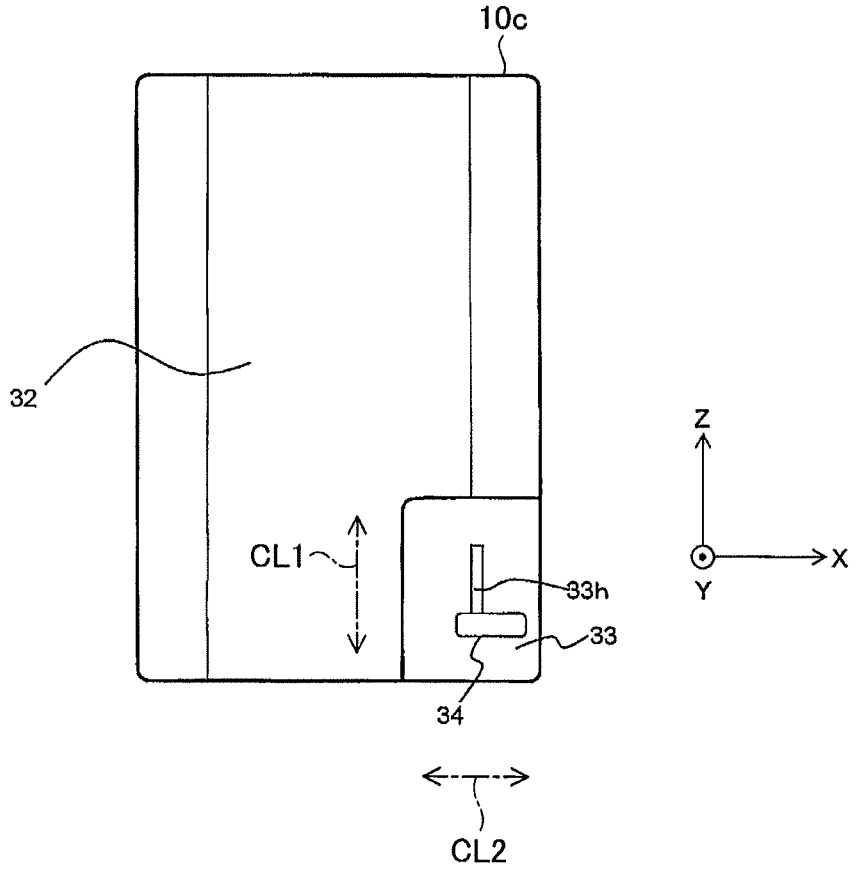
FIG. 11 shows the handle 34 state of a variation when the slider 371 is at the second position p32.

FIG. 11 is a front view of the case 10*c* of variation 8 in a state when the supply of ink from the ink tank unit 10 to the printer unit 20 is stopped. At this time, the connecting shaft 371*p* is positioned inside the locking part 33*s* of the guide hole 33*h* provided on the second plane part 33. As described previously, the locking pin 371*e* of the slider 371 is supported on the bearing 372*e* and the bearing 374*e* so as to be able to rotate around the Z axis as well (see arrow CL2 in FIG. 8). Because of this, the connecting shaft 371*p* connected to the slider 371 can be positioned at the locking part 33*s* of the guide hole 33*h*. The arrow CL2 in FIG. 8, FIG. 9 and FIG. 11 shows the rotation direction of the handle 34, the connecting shaft 371*p*, and the slider 371 that have the locking pin 371*e* as the center when the connecting shaft 371*p* is in the locking part 33*s*.

Figure 12:
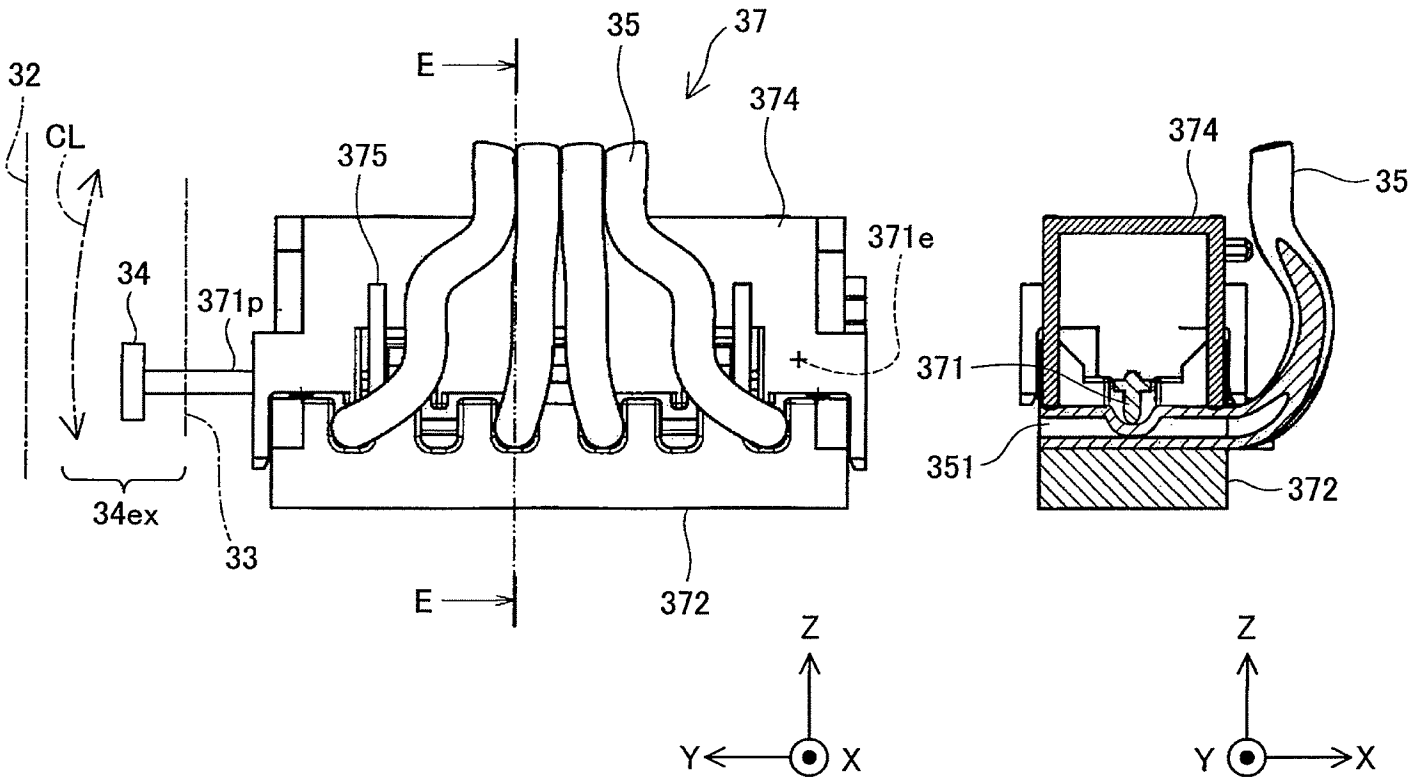
FIG. 12 shows the handle 34 state and the hose 35 state of a variation when the slider 371 is at the second position p32.

FIG. 12 is a drawing showing the orientation of the handle 34 in relation to the opening and closing unit 37 and the state of the hose 35 when in the position shown in FIG. 11. A side view of the opening and closing unit 37 is shown in the left side of FIG. 12. The E-E cross section of the left side view is shown in the right side of FIG. 12. When in the state in FIG. 12, the slider 371 flattens the four hoses 35 that pass through the interior of the opening and closing unit 37. Also, the four hoses 35 have the top surface and the bottom surface of the interior surfaces in contact in a specified section. The position of the slider 371 at this time is called the "second position p32."

When the slider 371 is at the second position p32, the ink cannot flow inside the four hoses 35 at the opening and closing unit 17. In this state, the slider 371 and the connecting shaft 371*p* are in an almost parallel state with the Y axis. Also, the slider 371 is constituted such that in this state, the bottom end part of the slider 371 pressing the four hoses 35 is almost horizontal (see FIG. 8 and FIG. 12). With such a mode, it is possible to stop the flow of the ink in all the hoses 35 arranged aligned in the horizontal direction with equal reliability.

From the state in FIG. 9 and FIG. 10, by moving the handle 34 in the X axis positive direction after pressing it downward in the Z axis negative direction, it is possible to stop the supply of ink from the ink tank unit 10 to the printer unit 20.

Note that when in the state of FIG. 11 and FIG. 12, the slider 371 receives Z axis positive direction force by the elastic force of the elastic portion 351 of the four hoses 35. As a result, the connecting shaft 371*p* connected to the slider 371 is pressed against the top end of the locking part 33*s* inside the locking part 33*s*. Because of this, it is possible to prevent the connecting shaft 371*p* from moving within the locking part 33*s* under conditions not intended by the user, by frictional force of the member constituting the top end of the locking part 33*s* and the connecting shaft 371*p*. Also, the locking part 33*s* extends in the direction (X axis direction) perpendicular to the direction of the reaction force (Z axis positive direction) received from the hose 35. Thus, it is possible to prevent the connecting shaft 371*p* from moving within the locking part 33*s* under conditions not intended by the user due to reaction force received from the hose 35.

When the handle 34 is operated from the state in FIG. 11 and FIG. 12 to the left (X axis negative direction) and the connecting shaft 371*p* leaves the locking part 33*s*, the slider 371 is pushed back from the second position p32 to the first position p31 (see FIG. 9 and FIG. 10) by the elastic force of the elastic portions 351 of the four hoses 35. Specifically, by the user moving the handle 34 from the state in FIG. 11 and FIG. 12 to the X axis negative direction, it is possible to restart the supply of ink from the ink tank unit 10 to the printer unit 20. Note that in either state, the position along the Y axis direction of the end part of the Y axis direction positive side of the handle 34 is positioned more to the side of the slider 371 than the first plane part 32 of the case 10*c*, specifically, the Y axis direction negative side (see FIG. 10 and FIG. 12).

With variation 8, it is possible to omit the cam 173 used with the embodiment. Also, it is possible to perform opening and closing of the flow path of the hoses 35 using a simpler constitution than the first embodiment.

B9. Variation 9

The above embodiments and variations describe printer unit 20 as the inkjet printer and the ink tank unit 10, but the present invention can also be applied to a liquid jetting device that jets or ejects liquids other than ink and to liquid supply devices that contain such a liquid. The liquid supply device of the present invention may be used in any of various liquid jetting devices equipped with a liquid jetting head or the like for ejecting small liquid droplets. Note that the term "droplet" means a state of liquid ejected from the aforementioned liquid jetting device, and may be a granular shape, a teardrop shape, or a tailing shape. The term "liquid" represents any material that can be jetted from the liquid jetting device. The liquid may be any of liquid-phase materials including liquids of high viscosity and liquids of low viscosity, sols, gel waters, various inorganic solvents, various organic solvents, solutions, liquid resins, liquid metals (fused metals), and is not limited to just liquids as a single state substance, but may also include the particles of functional solid materials, such as colorant particles or metal particles, dissolved, dispersed, or mixed in a solvent. Typical examples of the liquid include ink described in the above embodiments and liquid crystal. The "ink" includes aqueous inks, oil inks, gel inks, hot-melt inks, and other various liquid compositions. Specific examples of the "liquid jetting device" include a liquid jetting device for jetting dispersions or solutions of electrode materials or colorants used for manufacturing liquid crystal displays, EL (electroluminescence) displays, surface-emitting displays, or color filters, a liquid jetting device for jetting bioorganic materials used for manufacturing biochips, and a liquid jetting device used as a precision pipette for jetting sample liquids. It is also possible to use a liquid jetting device for jetting lubricating oil at exact positions on precision machinery, such as watches and cameras, a liquid jetting device for jetting transparent liquid resins, such as ultraviolet curable resin, onto a substrate for manufacturing hemispherical microlenses (optical lenses) for optical communication elements, or a liquid jetting device for jetting acid or alkaline etching solutions for etching substrates or the like. The present invention is also applicable to any one of such liquid jetting devices and liquid supply devices.

B10. Variation 10

Above, a detailed description of the present invention is given while referring to preferred exemplary embodiments. However, the invention of this application is not limited to the embodiments and constitutions described above. Also, the invention of this application includes various variations and equivalent constitutions. Furthermore, the various elements of the disclosed invention were disclosed in various combinations and constitutions, but these are just examples, and it is possible to use more, or fewer, of the various elements. It is also possible to have just one element. These modes are included in the scope of the invention of this application.

What is claimed is:

1. A liquid supply device for supplying liquid to a liquid jetting device, comprising:

a liquid containing chamber that contains liquid; and a tube for being connected to the liquid jetting device for supplying the liquid from the liquid containing chamber to the liquid jetting device, the tube including at least in part an elastic portion that can elastically deform, an opening and closing unit for allowing and preventing the supply of liquid from the liquid supply device to the liquid jetting device, the opening and closing unit including:

a slider;

a locking pin for locking the slider that is connected to one end of the slider;

an operating unit connected to the other end of the slider;

a support member for supporting the tube, the elastic portion of the tube being positioned between the slider and the support member; and a case which covers the liquid supply device, wherein the operating unit is positioned at the outside of the case wherein the operating unit is connected to the slider through a connecting shaft and the connecting shaft is movable within a guide hole provided in the case;

wherein the slider is movable between a first position and a second position with the locking pin as a rotating center, wherein when the slider is in the first position, the liquid can flow inside the tube; but when the slider is in the second position, the tube is pushed by the slider toward the support member and deformed to prevent the liquid flow inside the tube.

2. The liquid supply device according to claim 1, wherein the guide hole has a locking part and the connection shaft can be positioned at the locking part of the guide hole.

3. The liquid supply device according to claim 1, wherein the slider is movable between the first position and the second position along with the operating unit.

4. A liquid supply device for use with a liquid jetting device, wherein the liquid supply device is separate from, external to, and configured for attachment to the liquid jetting device to thereby supply liquid to the liquid jetting device, the liquid supply device comprising:

a liquid containing chamber that contains the liquid; and a tube configured to connect the liquid containing chamber to the liquid jetting device to thereby supply the liquid from the liquid containing chamber to the liquid jetting device, the tube comprising:

an elastic portion configured to elastically deform, an upstream end attached to the liquid containing chamber; and a downstream end configured for attachment to the liquid jetting device;

an opening and closing unit for allowing and preventing the supply of liquid from the liquid supply device to the liquid jetting device, the opening and closing unit comprising:

a slider;

a locking pin configured to lock the slider, wherein the locking pin is connected to a first end of the slider;

an operating unit connected to a second end of the slider;

a case which covers the liquid supply device, wherein the operating unit is positioned at the outside of the case; and a support member configured to support the tube, the elastic portion of the tube being positioned between the slider and the support member, wherein the slider and the support member are disposed downstream of the liquid containing chamber and upstream of the downstream end of the tube;

wherein the slider is movable between a first position and a second position with the locking pin as a rotating center, wherein when the slider is in the first position, the liquid can flow inside the tube; but when the slider is in the second position, the tube is pushed by the slider toward the support member and deformed to prevent the liquid flow inside the tube.

5. The liquid supply device according to claim 4, wherein the operating unit is connected to the slider through a connecting shaft and the connecting shaft is movable within a guide hole provided in the case.

6. The liquid supply device according to claim 5, wherein the guide hole has a locking part and the connection shaft can be positioned at the locking part of the guide hole.

* * * * *